United States Patent [19]

Koike et al.

[11] Patent Number: 4,686,546

[45] Date of Patent: Aug. 11, 1987

[54] HEAT-SENSITIVE RECORDING PAPER

[75] Inventors: Kazuyuki Koike; Shigehisa Tamagawa; Tetsuro Fuchizawa, all of Shizuoka, Japan

[73] Assignee: Fuji Photo Film Co., Ltd., Kanagawa, Japan

[21] Appl. No.: 807,135

[22] Filed: Dec. 9, 1985

[30] Foreign Application Priority Data

Dec. 11, 1984 [JP] Japan ..... 59-261406
Dec. 28, 1984 [JP] Japan ..... 59-277779
Apr. 15, 1985 [JP] Japan ..... 60-80022

[51] Int. Cl.[4] ..... B41M 5/18

[52] U.S. Cl. ..... 503/200; 503/207; 503/226; 427/152

[58] Field of Search ..... 346/200, 207, 226; 427/150–152

[56] References Cited

U.S. PATENT DOCUMENTS 4,168,845 9/1979 Oeda et al. ..... 346/209

FOREIGN PATENT DOCUMENTS 0086789 6/1980 Japan ..... 346/226
0140590 11/1980 Japan ..... 346/207
0116692 7/1982 Japan ..... 346/226
1535654 12/1978 United Kingdom ..... 346/226
2133568 7/1984 United Kingdom ..... 346/209

*Primary Examiner*—Bruce H. Hess
*Attorney, Agent, or Firm*—Sughrue, Mion, Zinn, Macpeak & Seas

[57] ABSTRACT

A heat-sensitive recording paper comprising a support having provided thereon a heat-sensitive recording layer, wherein an intermediate layer comprising at least one of an organic and inorganic pigment having an oil absorption property (JIS K-5101) of at least 30 ml/100 g and less than 50 ml/100 g is interposed between the support and the heat-sensitive recording paper. The heat-sensitive recording paper does not suffer from reduction in color density even when recording is effected with high energy.

24 Claims, No Drawings

HEAT-SENSITIVE RECORDING PAPER

FIELD OF THE INVENTION

This invention relates to a heat-sensitive recording paper wherein recording can be conducted with a thermal head, a thermal pen, etc. More particularly, it relates to a heat-sensitive recording paper comprising a support having provided thereon a heat-sensitive recording layer with an intermediate layer containing a pigment being interposed therebetween.

BACKGROUND OF THE INVENTION

Heat-sensitive recording papers comprise a support, e.g., paper, synthetic paper, plastic films, etc., having provided thereon a heat-sensitive color forming layer capable of developing a color upon heating, and have been widely used in various recording systems, such as electric calculators, thermal printers of terminals of computers, thermal pens of medical instruments, recorders, heat-sensitive facsimiles, automatic ticket vending machines, and the like. The heat-sensitive recording materials have generally been produced by separately pulverizing and dispersing a color forming agent, such as colorless or light-colored leuco dyes, lactone, lactam or spiropyran color forming dyes, and the like, and a developer capable of causing the color forming agent to develop a color upon heating, such as naphthol, catechol, resorcinol, 4,4'-isopropylidenediphenol, 4,4'-cyclohexylidenediphenol, benzoic acid, p-phenylphenol, and the like, in a ball mill, an attritor, a sand mill, etc., adding a resin binder, and, if necessary, a surface active agent, a defoaming agent, a wax, an inorganic pigment, etc., and coating the resulting composition to a support, such as a sheet of paper, followed by drying.

The thus produced heat-sensitive recording paper is heated with a thermal head or a thermal pen made of a resistance heating element, nichrome wire, etc., to form a color image.

In order to obtain high color densities with smaller energy or to reduce adhesion of the scum to the thermal head, etc., it has been proposed to provide an intermediate layer comprising an organic or inorganic pigment between the paper support and the heat-sensitive recording layer as described in Japanese Pat. Application (OPI) Nos. 23545/79 and 86792/81 (the term "OPI" as used herein refers to a "published unexamined Japanese patent application").

Also known is a method of forming an intermediate layer comprising an inorganic pigment having an oil absorption of not less than 60 ml/100 g, e.g., a calcium carbonate, as proposed in Japanese Patent Publication No. 52915/82 and a method of forming an intermediate layer comprising a urea-formaldehyde resin as an organic pigment as described in Japanese Patent Application (OPI) No. 103892/82.

Further, in order to improve image quality, i.e., dot reproducibility of a heat-sensitive head, a method in which a heat-sensitive layer is provided on a lightweight coated paper having an optical surface roughness (Rp) of not more than 8 μm has been proposed as disclosed in Japanese Patent Application (OPI) No. 136492/83.

These conventional heat-sensitive recording papers, however, involve a disadvantage in that the color forming components are absorbed in the intermediate layer when recording is effected by high energy, or during preservation after the color development, thus resulting in reduction of color density. Therefore, a heat-sensitive recording material that can fully satisfy the need for both excellent color density and image quality has not yet been obtained.

SUMMARY OF THE INVENTION

An object of this invention is to provide a heat-sensitive recording paper which does not suffer from reduction in color density even when recording is effected with high energy.

Other objects of this invention is to provide a heat-sensitive recording paper which does not suffer from reduction in color density even when recording is effected with high energy, provides high color density even when recording is effected with low energy, and provides an image of satisfactory quality.

A further object of this invention is to provide a heat-sensitive recording paper which provides high color density and does not suffer from reduction in color density even when preserved for a long period of time after color development.

In order to overcome the above-described disadvantages of the conventional heat-sensitive recording paper, extensive investigations have been conducted. As a result, it has now been found that a heat-sensitive recording paper which provides high color density even upon application of high energy can be obtained by providing an intermediate layer comprising at least one of an organic and inorganic pigment having an oil absorption property (as specified in JIS K-5101) of at least 30 ml/100 g and less than 50 ml/100 g between a support and a heat-sensitive recording layer thereby to prevent penetration of color forming components into the intermediate layer.

It has also been found that high color density and satisfactory image quality can be obtained preferably by adjusting the optical surface roughness (Rp) of the above-described intermediate layer not to exceed 4 μm, and more preferably not to exceed 3 μm.

It has further been found that a heat-sensitive recording paper which provides high color density and does not undergo reduction in color density during long term preservation can be obtained by incorporating a dialkylsulfosuccinic acid salt into the above-described intermediate layer.

DETAILED DESCRIPTION OF THE INVENTION

The inorganic or organic pigments which can be used in the present invention include calcined kaolin, kaolin, talc, barium sulfate, titanium oxide, light calcium carbonate, synthetic silica, natural silica, a polystyrene resin, a polyethylene resin, a urea-formalin resin, etc., with calcined kaolin, kaolin, talc and mixtures thereof being preferred.

The pigment has an average particle size of from 1 to 10 μm, and preferably from 2 to 6 μm.

The intermediate layer according to the present invention preferably has an optical surface roughness (Rp) of not greater than 4 μm, and more preferably not greater than 3 μm.

The term "optical surface roughness (Rp)" as herein used is obtained by optically measuring the surface roughness of the intermediate layer with a prism being pressed thereonto. The principle applied to the measurement is described in Shinpei Inamoto, Report of Printing Bureau Lab. of Ministry of Finance, "Method of Measuring Printing Smoothness of Paper, Centered in Optical Contact Method", Vol. 29-G, 615–622 (Sept., 1977). The apparatus that can be used for the measurement includes a dynamic printing smoothness measuring apparatus manufactured by Toyo Seiki Seisakusho K.K. The optical surface roughness (Rp) as herein referred to is measured by applying the prism to the intermediate layer under a pressure of 5 kg/cm$^2$.

The optical surface roughness (Rp) of not greater than 4 um can preferably be attained by subjecting the intermediate layer to gloss calendering or supercalendering. The calendering can be carried out at a temperature of from 50° to 150° C.

In order to prevent reduction in color density due to absorption of the color forming components in the intermediate layer at the time of heat recording or during preservation after heat recording, it is preferable to add a dialkylsulfosuccinic acid salt to the intermediate layer.

The dialkylsulfosuccinic acid salt which can be used in the present invention preferably includes a sodium salt and a potassium salt, and more preferably a compound represented by formula (I)

$$\begin{array}{l} CH_2COOC_nH_{2n+1} \\ | \\ CHCOOC_nH_{2n+1} \\ | \\ SO_3X \end{array} \quad (I)$$

wherein X represents a sodium atom or a potassium atom; and n represents an integer of from 3 to 11.

Among the dialkylsulfosuccinic acid salts represented by formula (I), those wherein n is an integer of from 6 to 10 are particularly preferred.

Specific examples of the dialkylsulfosuccinic acid salts useful in the present invention are shown below.

$$\begin{array}{l} CH_2COOC_6H_{13} \\ | \\ CHCOOC_6H_{13} \\ | \\ SO_3Na \end{array} \quad (1)$$

$$\begin{array}{l} CH_2COOC_8H_{17} \\ | \\ CHCOOC_8H_{17} \\ | \\ SO_3Na \end{array} \quad (2)$$

$$\begin{array}{l} CH_2COOC_{10}H_{21} \\ | \\ CHCOOC_{10}H_{21} \\ | \\ SO_3Na \end{array} \quad (3)$$

$$\begin{array}{l} CH_2COOC_6H_{13} \\ | \\ CHCOOC_6H_{13} \\ | \\ SO_3K \end{array} \quad (4)$$

$$\begin{array}{l} CH_2COOC_8H_{17} \\ | \\ CHCOOC_8H_{17} \\ | \\ SO_3K \end{array} \quad (5)$$

The above-described dialkylsulfosuccinic acid salt is added to the intermediate layer in an amount of from 0.1 to 10 parts by weight, and preferably from 0.3 to 3.0 parts by weight, per 100 parts by weight of the organic and/or inorganic pigments.

Binders which can be used for the intermediate layer according to the present invention include water-soluble high polymers, such as starch, starch derivatives, carboxymethyl cellulose and polyvinyl alcohol; and hydrophobic high polymer-emulsions, e.g., SBR (styrenebutadiene rubber), MBR (methyl methacrylate-butadiene rubber), and acrylic resins and, in addition, any of water-soluble and hydrophobic high polymeric compounds analogous to these compounds.

If desired, the intermediate layer may contain a surface active agent, a dispersing agent, a tackifier, a waterproofing agent, a defoaming agent, and so on.

The intermediate layer is coated in an amount of from 3 g/m$^2$ to 20 g/m$^2$.

Coating of the intermediate layer can be carried out by known techniques, such as air knife coating, blade coating, gravure coating, roll coating, spray coating, dip coating, bar coating, extrusion coating, and the like.

A heat-sensitive coating composition which can be used for the heat-sensitive recording layer in accordance with the present invention is described below.

The color forming agent (hereinafter, color former) to be used in the present invention is not particularly restricted, and any of those employed in general pressure-sensitive recording paper, heat-sensitive recording paper, and the like may be used. Specific examples of usable color forming agents include (1) triarylmethane compounds, such as 3,3-bis(p-dimethylamino-phenyl) 6-dimethylaminophthalide (Crystal Violet Lactone), 3-(p-dimethylaminophenyl)-3-(1,2-dimethylindol-3 3-yl)phthalide, 3-(p-dimethylaminophenyl)-3-(2-phenyliol3-yl)phthalide, 3,3-bis(p-ethylcarbazol-3-yl)-3-dimethylaminophthalide, 3,3-bis(2-phenylindol-3-yl)-5-dimethylaminophthalide, etc.; (2) diphenylmethane compounds, such as 4,4-bisdimethylaminobenzhydrin benzyl ether, an N-halophenylleucoauramine, N-2,4,5-trichlorophenylleucoauramine, etc.; (3) xanthene compounds, such as Rhodamine B-anilinolactam, 3-diethylamino-7-dibenzylaminofluoran, 3-diethylamino-7-butylaminofluoran, 3-diethylamino-7-(2-chloroanilino)-fluoran, 3-diethylamino6-methyl-7-anilinofluoran, 3-pipridino-6-methyl-7-anilinofluoran, 3-ethyltolylamino-6-methyl-7-anilinofluoran, 3-cyclohexylmethylamino-6-methyl-7-anilinofluoran, 3-diethylamino-6-chloro-7-(β-ethoxyethyl)aminofluoran, 3-diethylamino-6-chloro-7-(γ-chloropropyl)aminofluoran, 3-diethylamino-6-chloro-7-anilinofluoran, 3-N-cyclohexyl-N-methylamino-6-methyl-7-anilinofluoran, 3-diethylamino-7-phenylfluoran, etc.; (4) thiazine compounds, such as benzoyl Leucomethylene Blue, p-nitrobenzyl Leucomethylene Blue, etc.; and (5) spiro compounds, such as 3-methyl-spiro-dinaphthopyran, 3-ethyl-spirodinaphthopyran, 3-benzylspiro-dinaphthopyran, 3-methyl-napththo-(3-methoxybenzo)-spiropyran, etc.; and mixtures thereof. The color forming agent to be used can appropriately be selected from these compounds depending on the end use and the desired characteristics.

The developer which can be used in the present invention preferably includes phenol derivatives and aromatic carboxylic acid derivatives, and more preferably bisphenols. Specific examples of the phenol derivatives are p-octylphenol, p-tert-butylphenol, p-phenylphenol, 2,2-bis(p-hydroxy)propane, 1,1-bis(p-hydroxyphenyl)-pentane, 1,1-bis(p-hydroxyphenyl)hexane, 2,2-bis(p-hydroxyphenyl)hexane, 1,1-bis(p-hydroxyphenyl)-2-ethylhexane, 2,2-bis(4-hydroxy-3,5-dichlorophenyl)propane, etc. Specific examples of the aromatic carboxylic acid derivatives include p-hydroxybenzoic acid, propyl p-hydroxybenzoate, butyl p-hydroxybenzoate, benzyl p-hydroxybenzoate, 3,5-di-α-methylbenzylsalicylic acid and polyvalent metal salts of such carboxylic acids.

It is preferable to use these developers in the form of an eutectic mixture with a heat-fusible substance having a low melting point or in the state in which such a low melting compound is fused onto surfaces of the developer particles so as to fuse the developer at a desired temperature to cause a color formation reaction.

The heat-sensitive coating composition for the heat-sensitive recording layer can usually be prepared by separately dispersing each of the color former and the developer in a water-soluble high polymer solution by means of a ball mill, etc. Taking a ball mill for instance, finely ground particles of the color former or the developer can be obtained by dispersing for a sufficient period of time using balls having different diameters in appropriate proportions. A model sand mill (available under the trademark "Dynomill") may also effectively be employed.

The resulting dispersions of each of the color former and the developer are mixed together, and inorganic pigments, waxes, higher fatty acid amides, metallic soaps, and, if desired, ultraviolet absorbents, antioxidants, latex binders and the like are added thereto to prepare a coating composition. These additives may be added at the time of dispersion.

The waxes to be incorporated in the coating composition include paraffin wax, carnauba wax, microcrystalline wax, polyethylene wax and, in addition, higher fatty acid amides, e.g., stearamide, ethylene-bis-stearamide, higher fatty acid esters, etc.

The metallic soaps include polyvalent metal salts of higher fatty acids, e.g., zinc stearate, aluminum stearate, calcium stearate, zinc oleate, etc.

The inorganic pigments include kaolin, calcined kaolin, talc, agalmatolite, diatomacecus earth, calcium carbonate, aluminum hydroxide, magnesium hydroxide, magnesium carbonate, titanium oxide, barium carbonate, etc.

These inorganic pigments incorporated in a recording layer preferably have an oil absorption property of not less than 60 ml/100 g and an average particle size of not greater than 5 μm. Such an oil-absorbing inorganic pigment is incorporated in a recording layer in an amount of from 5 to 50% by weight, and preferably from 10 to 40% by weight, based on the recording layer.

The above-described components of the coating composition for the heat-sensitive recording layer are dispersed in a binder. The binder to be used is generally water-soluble, and specific examples include polyvinyl alcohol, hydroxyethyl cellulose, hydroxypropyl cellulose, an ethylene-maleic anhydride copolymer, a styrene-maleic anhydride copolymer, an isobutylene-maleic anhydride copolymer, polyacrylic acid, a starch derivative, casein, gelatin, and so on.

For the purpose of imparting waterproofing property to the binder (i.e., to waterproof the recording paper), a waterproofing agent (i.e., gelling agent or cross-linking agent) or an emulsion of a hydrophobic polymer, e.g., a styrene-butadiene rubber latex, an acrylic resin emulsion, etc., can be added.

The binder is used in an amount of from 10 to 30% by weight on a dry basis, based on the weight of the recording layer.

In addition to the above-described components, the coating composition for the heat-sensitive recording layer may further contain various additives, such as a defoaming agent, a fluorescent dye, a coloring dye, etc., if desired.

The thus prepared coating composition can be coated on the support by any known coating techniques, such as blade coating, air knife coating, gravure coating, roll coating, spray coating, dip coating, bar coating, extrusion coating, and the like.

The coverage of the coating composition is not particularly limited, but usually ranges from 3 to 15 g/m$^2$, and preferably from 4 to 10 g/m$^2$, on a dry basis. This composition coverage corresponds to a coverage of the color former ranging from 0.2 g/m$^2$ to 1.0 g/m$^2$.

The paper support, which can be used in the present invention, preferably has an internal bond strength of from 0.5 to 2.5 kg.cm according to the specification of TAPPI (Technical Association of the Pulp and Paper Industry, New York) RC-308. If the internal bond strength is higher than 2.5 kg.cm, the compressive properties of the paper tends to be reduced, resulting in decrease in color density. On the other hand, an internal bond strength less than 0.5 kg.cm may cause problems, such as breakage of the paper support during coating.

After coating of the recording layer, it is desirable that the surface of the recording layer be subjected to surface treatment by passing through a pressing element composed of a metal roll heated at 40° to 60° C. and an elastic roll in such a manner that the heat-sensitive recording layer contacts the metal roll under a condition that the heat-sensitive recording paper has a water content of from 5% to 12% by weight, so as to provide a preferable optical surface roughness (Rp) of not more than 3.5 μm. If the optical surface roughness (Rp) of the recording layer is more than 3.5 μm, the image quality, i.e., reproducibility of a heat-sensitive head, tends to become deteriorated.

The present invention will now be illustrated in greater detail with reference to the following examples and comparative examples, but it should be understood that the present invention is not limited thereto. In these examples, all percents and ratios are by weight unless otherwise indicated.

EXAMPLES 1 TO 3 AND COMPARATIVE EXAMPLES 1 TO 3

Formation of Intermediate Layer

Each of coating compositions having the formulations shown in Table 1 was thoroughly stirred, coated on fine paper having a basis weight of 45 g/m$^2$ and an internal bond strength indicated in Table 1 with an air knife coater to a dry coverage of 10 g/m$^2$, and dried at 140° C. to form an intermediate layer.

Formation of Heat-Sensitive Layer 20 kg of Crystal Violet Lactone were dispersed in a 10% aqueous solution of polyvinyl alcohol (degree of saponification: 98%; degree of polymerization: 500) in a 300-liter volume ball mill for 1 day. Likewise, 20 kg of 2,2-bis(4-hydroxyphenyl)propane was dispersed in a 10% aqueous solution of polyvinyl alcohol in a 300 liter volume ball mill for 1 day. Both the resulting dispersions were mixed in such a proportion that the weight ratio of Crystal Violet Lactone to 2,2-bis(4hydroxyphenyl)propane was 1/5. To 20 kg of the resulting mixture was added 5 kg of lightweight calcium carbonate, followed by thoroughly dispersing to prepare a coating composition.

The coating composition was coated on the above-described intermediate layer to a coverage of 6 g/m$^2$ on a solid basis with an air knife coater, dried in hot air at 50° C. and calendered.

Evaluation of Color Density

Heat-sensitive recording was carried out on the resulting heat-sensitive recording papers under conditions of a recording speed of 2 milliseconds per dot; a recording density of 5 dots/mm in a main scanning direction and 6 dots/mm in a secondary scanning direction; and a thermal head energy of 30 mJ/mm$^2$ or 50 mJ/mm$^2$. The color density of the recorded image was evaluated by measuring the reflection density at 610 nm. The results obtained are shown in Table 1.

TABLE 1

| | Example | | | Comparative Example | | |
|---|---|---|---|---|---|---|
| | 1 | 2 | 3 | 1 | 2 | 3 |
| Formulation of Intermediate Layer | | | | | | |
| Calcined kaolin (42 ml/100 g)* | 30 | 50 | 80 | — | — | — |
| Talc (35 ml/100 g)* | 70 | 50 | 20 | — | — | — |
| Calcined kaolin (82 ml/100 g)* | — | — | — | 100 | — | — |
| Kaolin (65 ml/100 g)* | — | — | — | — | 100 | — |
| Urea-formaldehyde resin (150 ml/100 g)* | — | — | — | — | — | 100 |
| SBR | 20 | 20 | 20 | 20 | 20 | 20 |
| Sodium polyacrylate | 0.5 | 0.5 | 0.5 | 0.5 | 0.5 | 0.5 |
| Internal Bond | 1.6 | 1.6 | 1.6 | 1.6 | 1.6 | 1.6 |
| Strength of Support (kg · cm) | | | | | | |
| Color Density | | | | | | |
| 30 mJ/mm$^2$ | 0.88 | 0.89 | 0.87 | 0.89 | 0.85 | 0.89 |
| 50 mJ/mm$^2$ | 1.30 | 1.29 | 1.28 | 1.10 | 1.14 | 1.06 |

Note: *Values in parentheses indicate oil absorption (hereinafter the same)

It is apparent from the results of Table 1 above that the heat-sensitive recording papers in accordance with the present invention show high color densities upon application of either high or low energy, which indicates superiority of the present invention.

EXAMPLES 4 TO 7 AND COMPARATIVE EXAMPLES 4 TO 7

Formation of Intermediate Layer

Each of coating compositions having the formulations shown in Table 2 below was thoroughly stirred, coated on fine paper having a basis weight of 45 g/m$^2$ to a dry coverage of 10 g/m$^2$ with an air knife coater and dried in hot air at 120° C. to form an intermediate layer. The thus formed intermediate layer was then subjected to supercalendering at 80° C. so as to have an optical surface roughness (Rp) shown in Table 2 below.

Formation of Heat-Sensitive Layer

The same coating composition for a heat-sensitive layer as used in Examples 1 to 3 was coated on the above-described intermediate layer to a coverage of 6 g/m$^2$, on a solids basis, with an air knife coater, dried in hot air at 50° C. so as to have a water content of 7%, and then passed between a metal roll heated at 60° C. and an elastic roll with the heat-sensitive recording layer contacting with the metal roll so as to have an optical surface roughness (Rp) shown in Table 2.

Evaluation of Color Density

Heat-sensitive recording was carried out on the resulting heat-sensitive recording papers under the same conditions as used in Examples 1 to 3, and the color density of the recorded image was determined in the same manner as in Examples 1 to 3.

Further, the image quality was relatively evaluated. The results obtained are shown in Table 2 below.

TABLE 2

| | Example | | | | Comparative Example | | | |
|---|---|---|---|---|---|---|---|---|
| | 4 | 5 | 6 | 7 | 4 | 5 | 6 | 7 |
| Formulation of Intermediate Layer | | | | | | | | |
| Calcined kaolin (42 ml/100 g) | 30 | 50 | 80 | 80 | 80 | — | — | — |
| Talc (35 ml/100 g) | 70 | 50 | 20 | 20 | 20 | — | — | — |
| Calcined kaolin (82 ml/100 g) | — | — | — | — | — | 100 | — | — |
| Kaolin (65 ml/100 g) | — | — | — | — | — | — | 100 | — |
| Urea-formaldehyde resin (150 ml/100 g) | — | — | — | — | — | — | — | 100 |
| SBR | 20 | 20 | 20 | 20 | 20 | 20 | 20 | 20 |
| Sodium polyacrylate | 0.5 | 0.5 | 0.5 | 0.5 | 0.5 | 0.5 | 0.5 | 0.5 |
| Optical Surface Roughness (Rp) of Intermediate Layer (μm) | 2.0 | 1.9 | 2.2 | 3.5 | 7.0 | 4.8 | 5.2 | 4.3 |
| Optical Surface Roughness (Rp) of Heat-Sensitive Layer (μm) | 1.8 | 1.6 | 1.9 | 3.0 | 6.3 | 4.2 | 4.7 | 3.9 |
| Color Density | | | | | | | | |
| 30 mJ/mm$^2$ | 0.91 | 0.92 | 0.91 | 0.88 | 0.85 | 0.89 | 0.85 | 0.89 |
| 50 mJ/mm$^2$ | 1.30 | 1.29 | 1.28 | 1.28 | 1.28 | 1.10 | 1.14 | 1.06 |
| Image Quality** | A | A | A | B | x | C | x | C |

Note: ** A: Excellent, B: Fairly, C: Good, x: Poor

It can be seen from the results shown in Table 2 above that the heat-sensitive recording papers in accordance with the present invention show high color densities and satisfactory image qualities upon application of either high or low energy, which indicates superiority of the present invention.

EXAMPLES 8 TO 10 AND COMPARATIVE EXAMPLE 8

Formation of Intermediate Layer

Each of coating compositions having the formulations shown in Table 3 was coated on fine paper having a basis weight of 50 g/m$^2$ to a dry coverage of 10 g/m$^2$ with an air knife coater, and dried at 140° C. to form an intermediate layer.

Formation of Heat-Sensitive Layer

A heat-sensitive recording layer was formed on the above-described intermediate layer in the same manner as described in Examples 1 to 3.

Evaluation of Color Density

Heat-sensitive recording was carried out on the resulting heat-sensitive recording papers under the same conditions as used in Examples 1 to 3 except that the energy of the thermal head was 50 mJ/mm$^2$, and the color density of the recorded image was determined in the same manner as in Examples 1 to 3.

Further, the thus color developed heat-sensitive recording paper was preserved under severe conditions of 50° C. in temperature, 90% in relative humidity and 24 hours in time, and then the color density of the recorded image was determined.

These results are shown in Table 3 below.

TABLE 3

| | Example | | | Comparative |
|---|---|---|---|---|
| | 8 | 9 | 10 | Example 8 |
| Formulation of Intermediate Layer | | | | |
| Calcined kaolin (42 ml/100 g)* | 100 | 100 | 100 | 100 |
| SBR | 15 | 15 | 15 | 15 |
| Sodium dioctylsulfosuccinate of the following formula | 0.3 | 1 | 3 | — |
| Water | 200 | 200 | 200 | 200 |
| Color Density | | | | |
| Immediately after recording | 1.25 | 1.28 | 1.31 | 1.16 |
| After preservation (50° C., 90% RH, 24 hours) | 1.23 | 1.26 | 1.30 | 1.06 |

Note:
*Values in parentheses indicate oil
Sodium Dioctylsulfosuccinate:

$$\begin{array}{l} CH_2COOC_8H_{17} \\ | \\ CHCOOC_8H_{17} \\ | \\ SO_3Na \end{array}$$

It can be seen from Table 3 that the heat-sensitive recording papers according to the present invention, in which a dialkylsulfosuccinic acid salt is added to the intermediate layer, possess excellent quality in terms of color density either at the time of heat-sensitive recording and furthermore during preservation after the recording.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper comprising a support having provided thereon a heat-sensitive recording layer, wherein an intermediate layer comprising at least one inorganic pigment having an oil absorption property (JIS K-5101) of at least 30 ml/100 g and less than 50 ml/100 g is interposed between the support and the heat-sensitive recording layer.

2. A heat-sensitive recording paper as in claim 1, wherein said pigment is calcined kaolin, kaolin, talc, or a mixture thereof.

3. A heat-sensitive recording paper as in calim 2, wherein said heat-sensitive recording paper has an optical surface roughness (Rp) of not more than 3.5 μm.

4. A heat-sensitive recording paper as in claim 1, wherein said pigment has an average particle size of from 1 to 10 μm.

5. A heat-sensitive recording paper as in claim 4, wherein said heat-sensitive recording paper has an optical surface roughness (Rp) of not more than 3.5 μm.

6. A heat-sensitive recording paper as in claim 1, wherein said intermediate layer has a coverage of from 3 g/m$^2$ to 20 g/m$^2$.

7. A heat-sensitive recording paper as in claim 6, wherein said heat-sensitive recording paper has an optical surface roughness (Rp) of not more than 3.5 μm.

8. A heat-sensitive recording paper as in claim 1, wherein said support is a sheet of paper having an internal bond strength (TAPPI RC-308) of from 0.5 kg.cm to 2.5 kg.cm.

9. A heat-sensitive recording paper as in claim 8, wherein said heat-sensitive recording paper has an optical surface roughness (Rp) of not more than 3.5 μm.

10. A heat-sensitive recording paper as in claim 8, wherein said intermediate layer has an optical surface roughness (Rp) of not more than 3 μm.

11. A heat-sensitive recording paper as in claim 1, wherein said intermediate layer has an optical surface roughness (Rp) of not more than 4 μm.

12. A heat-sensitive recording paper as in claim 11 wherein said heat-sensitive recording paper has an optical surface roughness (Rp) of not more than 3.5 μm.

13. A heat-sensitive recording paper as in claim 1, wherein said heat-sensitive recording paper has an optical surface roughness (Rp) of not more than 3.5 μm.

14. A heat-sensitive recording paper as in claim 1, wherein said intermediate layer further comprises a dialkylsulfosuccinic acid salt.

15. A heat-sensitive recording paper as in claim 14, wherein said dialkylsulfosuccinic acid salt is represented by formula (I)

$$\begin{array}{l} CH_2COOC_nH_{2n+1} \\ | \\ CHCOOC_nH_{2n+1} \\ | \\ SO_3X \end{array} \qquad (I)$$

wherein X represents a sodium atom or a potassium atom; and n represents an integer of from 3 to 11.

16. A heat-sensitive recording paper as in claim 15, wherein n represents an integer of from 6 to 10.

17. A heat-sensitive recording paper as in claim 14, wherein said dialkylsulfosuccinic acid salt is present in an amount of from 0.1 to 10 parts by weight per 100 parts by weight of pigment.

18. A heat-sensitive recording paper as in claim 17, wherein said dialkylsulfosuccinic acid salt is present in an amount of from 0.3 to 3.0 parts by weight per 100 parts by weight of pigment.

19. A heat-sensitive recording paper as in claim 1 wherein said pigment has an average particle size of from 2 to 6 μm.

20. A heat-sensitive recording paper as in claim 1, wherein said intermediate layer has an optical surface roughness (Rp) of not more than 3 μm.

21. A heat-sensitive recording paper as in claim 1 wherein said pigment is calcined kaolin.

22. A heat-sensitive recording paper as in claim 1, wherein said pigment is kaolin.

23. A heat-sensitive recording paper as in claim 1, wherein said pigment is talc.

24. A heat-sensitive recording paper as in claim 1, wherein said pigment is a mixture of calcined kaolin and talc.

* * * * *